US006129615A

United States Patent [19]

Corman

[11] Patent Number: 6,129,615

[45] Date of Patent: Oct. 10, 2000

[54] DEBURRING MACHINE

[75] Inventor: Jeffrey P. Corman, Savage, Minn.

[73] Assignee: Continental Machines, Inc., Savage, Minn.

[21] Appl. No.: 09/428,227

[22] Filed: Oct. 27, 1999

[51] Int. Cl.[7] ..... B24B 21/00

[52] U.S. Cl. ..... 451/296; 451/299; 451/302; 451/300

[58] Field of Search ..... 451/296, 299, 451/300, 301, 302, 309, 336, 49

[56] References Cited

U.S. PATENT DOCUMENTS

| | | |
|---|---|---|
| 2,479,689 | 8/1949 | Maxfield . |
| 2,714,278 | 8/1955 | Dostert . |
| 3,176,435 | 4/1965 | Swierbut et al. . |
| 3,624,965 | 12/1971 | Gepfert . |
| 4,048,761 | 9/1977 | Cottrell . |
| 4,240,231 | 12/1980 | Day . |
| 4,322,918 | 4/1982 | Steinback . |
| 5,997,388 | 12/1999 | Canella et al. . |
| 6,001,004 | 12/1999 | Botteghi . |
| 6,033,522 | 3/2000 | Iwata et al. . |

*Primary Examiner*—Timothy V. Eley
*Assistant Examiner*—Willie Berry, Jr.
*Attorney, Agent, or Firm*—Cook, Alex, McFarron, Manzo, Cummings & Mehler, Ltd.

[57] ABSTRACT

A deburring machine having a work table with a side guide mounted thereto so as to define a first work zone for the lower peripheral edge of the cylindrical workpiece. A continuous elongated belt having an abrasive surface is mounted to the work table so as to engage the lower edge of the workpiece in the first work zone. A second side guide is spaced vertically from the work table in parallel alignment with the first side guide in conjunction with an overhead guide that engages the upper circular surface of the workpiece. The overhead guide and second side guide define a second work zone substantially in alignment with the first work zone, and a second continuous elongated abrasive belt engages the upper peripheral edge of the workpiece in the second work zone. An elongated drive belt is mounted to the work table in opposed, parallel relationship to the first and second side guides for engaging the cylindrical wall of the workpiece, the belt drive also holds the workpiece in engagement with the first and second side guides and moves the workpiece both rotationally and longitudinally along the surface of the work table.

5 Claims, 3 Drawing Sheets

DEBURRING MACHINE

The present invention relates to a machine for finishing the edges of workpieces, and, more particularly, to a deburring machine for cylindrical workpieces.

BACKGROUND OF THE INVENTION

In processing cylindrical workpieces, and particularly metal workpieces, one of the first steps is to cut to length a cylindrical piece from a length of cylindrical stock. In production processes, this means that large numbers of cylindrical workpieces are produced in the initial step of production. These workpieces are then subsequently handled and machined to provide the final product.

Saw-cut workpieces have burrs and sharp edges which must be removed prior to further handling. Removal of such burrs helps to prevent injury to workers handling the parts downstream of the saw and permits more accurate loading of the workpieces in the chucks of the tools that are subsequently used to machine the parts.

The removal of burrs for small-sized, cylindrical workpieces, i.e., those between approximately two inches to seven inches or more in diameter and two inches to six inches in height, has been a continuing problem. Manual methods involving filing or grinding are time consuming and carry a risk of repetitive motion and abrasion injuries. Semi-automatic machines for deburring cylindrical workpieces have been developed. See, e.g., U.S. Pat. No. 2,479,689 to Maxfield. However, such prior semi-automatic finishing machines have suffered from numerous disadvantages. For example, they have been noisy in operation, complicated in design and construction, and difficult to adjust with repeatable accuracy when handling workpieces of different sizes. Most importantly, the prior finishing machines are capable of deburring only one edge of a cylindrical workpiece per pass through the machine, thus requiring repeated handling of the workpiece.

Accordingly, it is an object of the present invention to provide a deburring machine for cylindrical workpieces that is capable of simultaneously machining both edges of a cylindrical workpiece in a single pass.

It is a further object of the present invention to provide such a deburring machine that is easily adjustable so as to accommodate cylindrical workpieces of varying diameter and height, and that such adjustments can be accurate and repeatable.

It is an additional object of the present invention to provide a deburring machine that is both quieter and safer in operation than currently available machines.

These objects, as well as others that will become apparent upon reference to the following detailed description and accompanying drawings, are provided by a deburring machine having a work table with a flat surface for supporting at least one cylindrical workpiece in substantially perpendicular relation thereto. The work table has an elongated, substantially straight edge, and a first side guide mounted to the work table and spaced in substantially parallel alignment with the straight edge of the work table so as to define a first work zone, the first side guide being adapted to engage the cylindrical wall of the workpiece adjacent to its lower peripheral edge.

A first continuous elongated belt having an abrasive surface is mounted to the work table and includes a drive motor. The first continuous elongated belt is disposed in the first work zone so that the abrasive surface of the belt engages the lower peripheral edge of the workpiece when the cylindrical wall of the workpiece abuts the first side guide.

A second side guide spaced vertically from the work table in substantially parallel alignment with the first side guide is provided for engaging the cylindrical wall of the workpiece adjacent to its upper peripheral edge. An overhead guide is spaced from the second side guide for engaging the upper circular surface of the workpiece, and the overhead guide and the second side guide define a second work zone that is substantially in alignment with the first work zone.

A second continuous elongated belt with an abrasive surface is provided along with a second drive motor and is disposed so that the abrasive surface of the second continuous elongated belt is disposed in the second work zone so as to engage the upper peripheral edge of the workpiece in the second work zone when the upper circular surface of the workpiece abuts the overhead guide. The second side guide, overhead guide, and second belt form a unit mounted to the work table that can be raised or lowered with respect to the work table to accommodate workpieces having heights within a predetermined range.

An elongated drive belt having a third drive motor is mounted to the work table in opposed, substantially parallel relationship to the first and second side guides. The drive belt engages the cylindrical wall of the workpiece to hold the workpiece in engagement with the first and second side guides and to move the workpiece both rotationally and longitudinally along the surface of the work table. As a consequence, both the lower and upper peripheral edges of the workpiece are rotated into the first and second work zones where they engage the abrasive surfaces of the first and second belts to remove the burrs thereon. The relative distance between the drive belt and the first and second side guides is adjustable to accommodate workpieces having diameters within the predetermined range.

DETAILED DESCRIPTION OF THE PREFERRED EMBODIMENT

Figure 1:
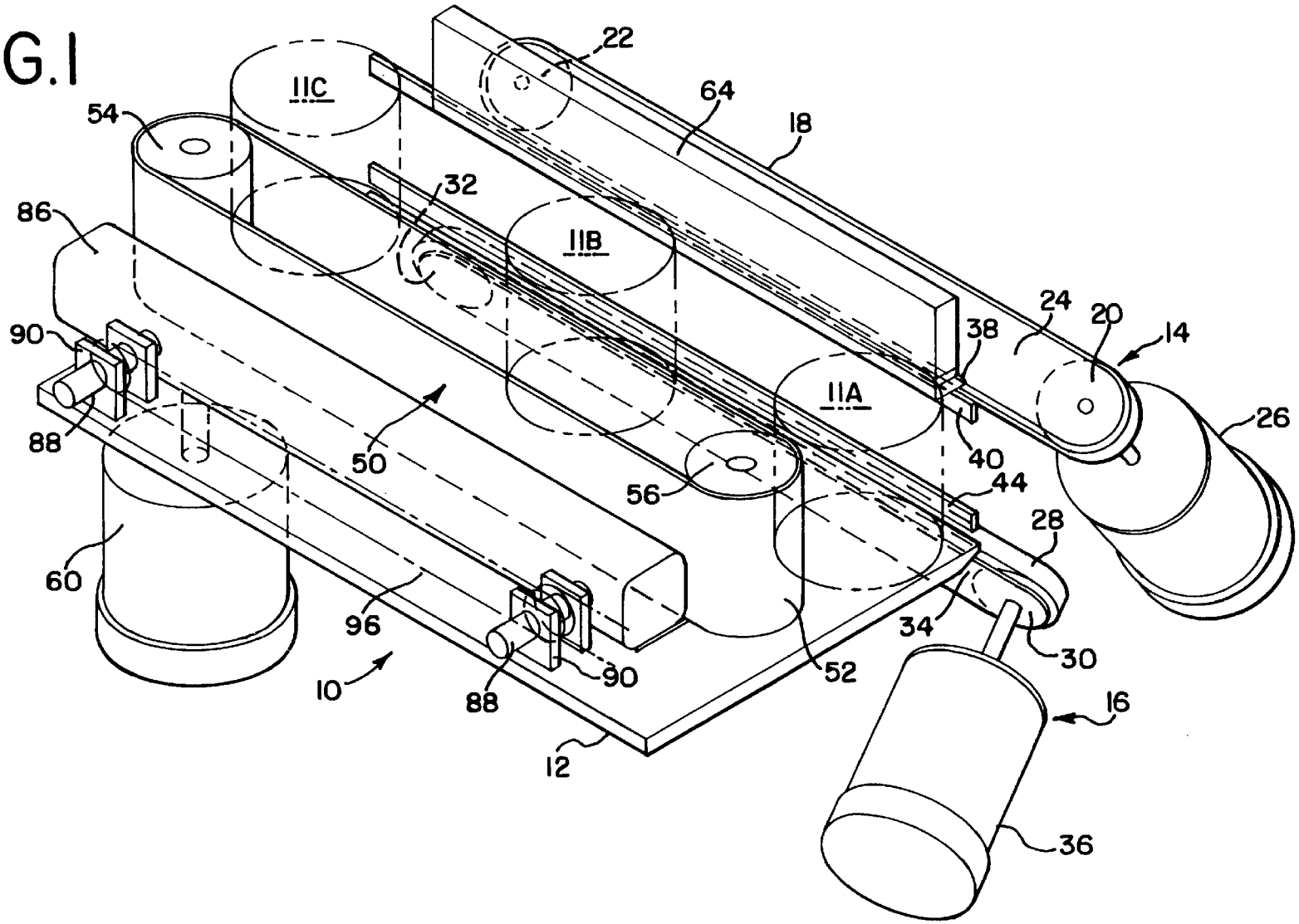
FIG. 1 is a perspective view of a deburring machine according to the present invention showing the relationship of its principal elements and in which the drive motors for the abrasive belts are at the same end of the deburring area.

Turning to the figures of the drawings, there is seen in FIG. 1 a perspective view of the principal elements of a deburring machine, generally designated 10, for simultaneously removing burrs from the top and bottom peripheral edges of cylindrical workpieces, 11A, 11B, and 11C, in accordance with the principles of the present invention. Guards, covers and other safety structures typically associated with such machines for protection of the user are not shown for purposes of clarity.

The deburring machine 10 includes a work table 12, which, for the purposes of this description, includes a main support 13 frame (best seen in FIG. 2) including a leg at each corner for supporting the table 12 on the floor. The frame 13 may allow for fixing the deburrer 10 to the floor by means of bolts or the like, or include wheels to allow for mobility. Additionally, the frame 13 may include adjustable-length legs to permit height adjustment. All of these variations for the frame 13 are well known in the art and, consequently, not shown in the drawings.

The deburrer 10 removes burrs from the upper and lower peripheral edges of a workpiece by "linishing," which is understood to mean polishing or removing excess material from an object by contact with a moving continuous belt coated with an abrasive material. To this end, the deburrer 10 includes upper and lower linishers, generally designated 14, 16, respectively, for deburring the upper and lower peripheral edges of a workpiece. The upper linisher unit 14 comprises a continuous belt 18 having an abrasive outer surface, the belt 18 being trained around a drive pulley 20 and an idler pulley 22 mounted to a carcase 24. The carcase 24 includes a flat platen (not shown) intermediate the pulleys 20, 22 that backs the continuous abrasive belt 18 and limits the extent to which it can be deflected. A drive motor 26 is connected to the drive pulley 20 by means of a shaft so as to provide for movement of the belt 18.

Figure 2:
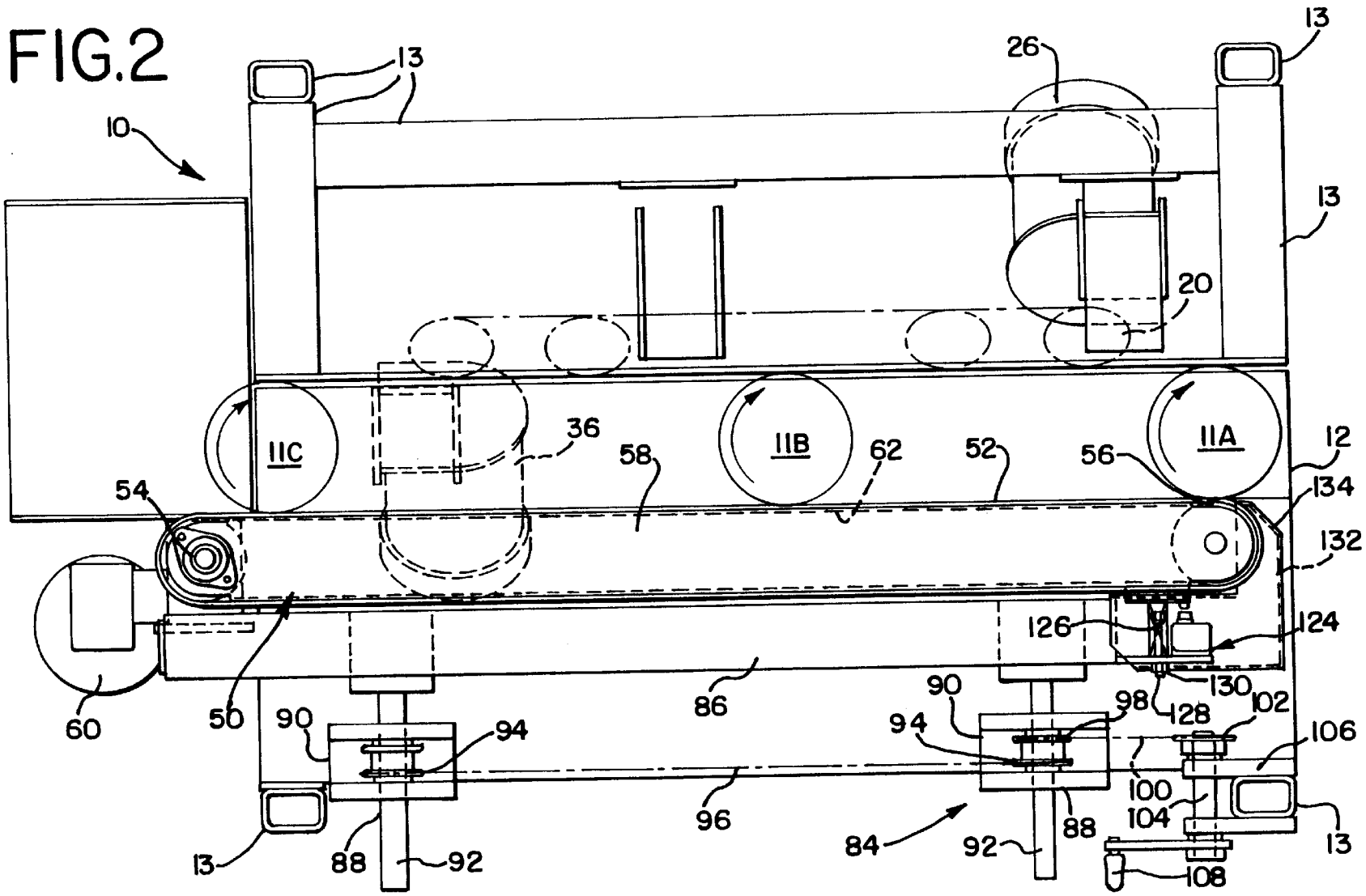
FIG. 2 is a top view of a deburring machine according to the present invention in which the drive motors for the abrasive belts are at opposing ends of the deburring area.

Similarly, the lower linisher unit 16 comprises a continuous belt 28 having an abrasive outer surface, the belt 28 being trained around a drive pulley 30 and idler pulley 32 that are supported on a carcase 34. The carcass 34 also includes a flat platen (not shown) intermediate the pulleys that backs the continuous abrasive belt 28 and limits the extent to which it can be deflected. A lower drive motor 36 is connected to the lower drive pulley 30 by means of a shaft for moving the lower belt 28. (FIG. 2 shows a variation of FIG. 1 in which the drive motor 36 is located at the opposite end of the work table 12 from the drive motor 26.)

In practice, both the upper and lower linishers 14, 16 include mechanisms for adjusting the tension and tracking alignment of their respective belts 18, 28. The tension mechanisms serve to tighten the belts for operation and loosen for removal and replacement, while the tracking mechanisms keep the belts tracking centrally on their pulleys. As these mechanisms are well known in the art, they are not shown in the drawings.

Figure 3:
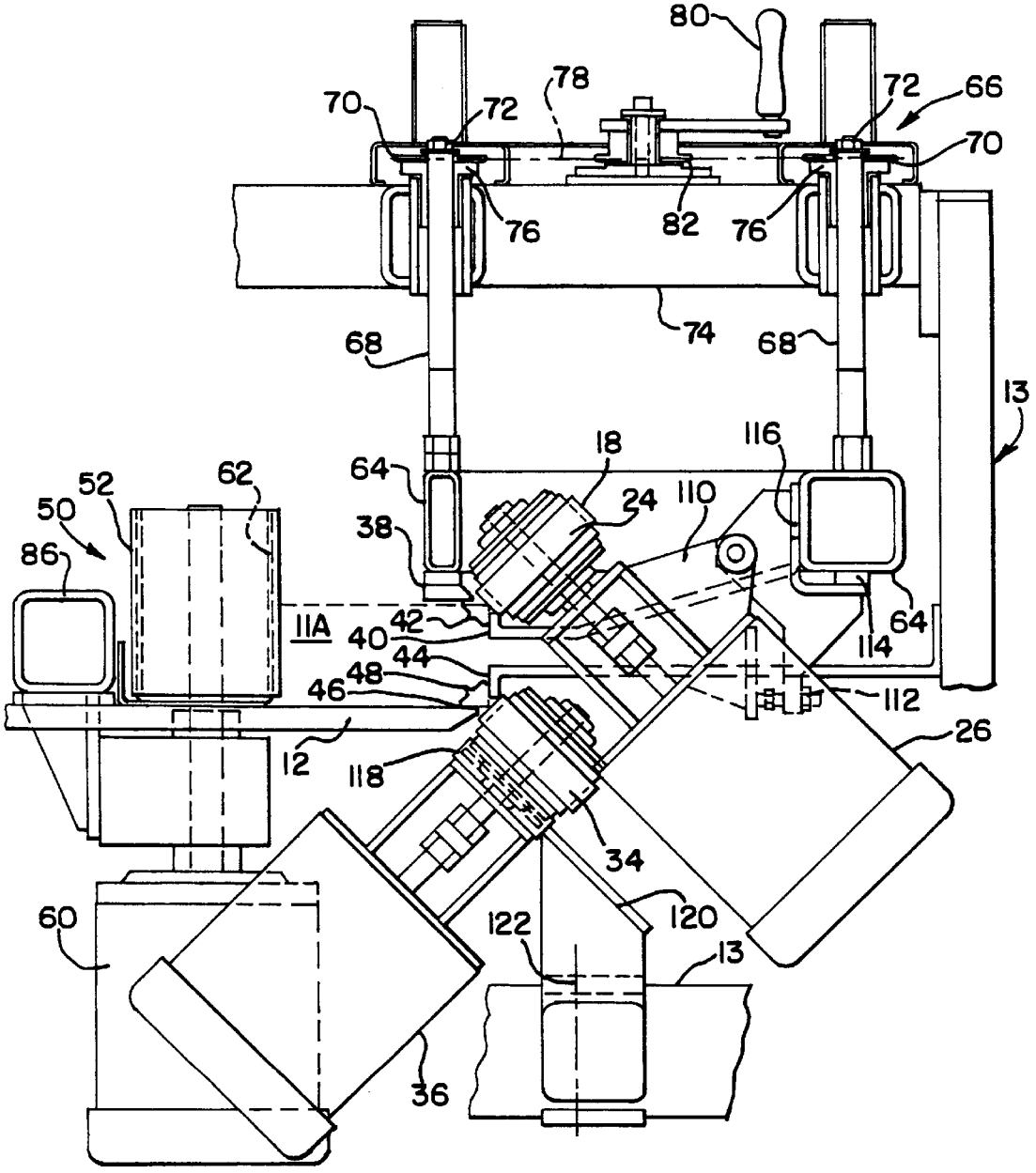
FIG. 3 is a side view of a deburring machine according to the present invention showing the relationship of the drive and abrasive belts to work zones defined by the top of the work table, the side guides, and overhead guide, and a height adjustment mechanism for the upper side guide and overhead guide. Portions of the table support are broken away to show detail.

An elongated overhead guide 38 and upper elongated side guide 40 form a unit that is movably mounted to the work table 12 so as to define an upper work zone (generally designated 42 and best seen in FIG. 3). The upper work zone 42 is associated with the upper linisher 14 and receives the upper peripheral edge of the workpiece as it moves along the work table 12 in contact with the abrasive belt 18. The overhead guide 38 engages the upper circular surface of the workpiece, while the upper side guide 40 engages the cylindrical wall of the workpiece adjacent to its upper peripheral edge.

Similarly, a lower side guide 44 is mounted to the work table 12 so as to combine with a substantially straight edge 46 of the work table to define a lower work zone (generally designated 48 and best seen in FIG. 3) associated with the lower linisher 16 that receives the lower peripheral edge of the workpiece as it moves along the work table 12 in contact with the abrasive face of the lower belt 20. The lower side guide 44 engages the cylindrical wall of the workpiece adjacent to its lower peripheral edge.

As can be appreciated, the length of the work zones should be no less than the circumference of the biggest workpiece to be deburred on the machine. This ensures that peripheral edges of the workpiece will be engaged by the abrasive surfaces of the upper and lower belts at least once as the workpiece travels through the work zone. Preferably, the work zone is three to four times the diameter of the biggest workpiece to be deburred in order to permit several workpieces to be deburred simultaneously.

The upper side guide 40 is spaced vertically from the work table 12 in substantially parallel alignment with the lower side guide 44, so that the cylindrical walls of the workpieces 11A, 11B, 11C simultaneously engage both the upper and lower side guides 40, 44 while the upper and lower peripheral edges of the workpieces 11A, 11B, 11C are being deburred (best seen in FIG. 3). Thus, the upper work zone 42 defined by the overhead guide 38 and upper side guide 40 is in substantial alignment with the lower work zone 48 defined by the straight edge 46 of the work table and the lower side guide 44.

To maintain the workpiece in contact with the upper and lower side guides, 44 and to move the workpiece along the work table while simultaneously rotating the upper and lower peripheral edges of the workpiece into the upper and lower work zones 42, 48, the deburring machine 10 includes a drive unit, generally designated 50, mounted to the work table 12. The drive unit 50 comprises an elongated belt 52 trained around a drive pulley 54 and an idler pulley 56, which are mounted to a carcase 58 (FIG. 2). The drive unit 50 further includes a drive motor 60 that has a shaft connecting it to the drive pulley 54. The drive unit 50 preferably includes a tensioning mechanism to tighten the drive belt 52 for operation and loosen the drive belt 52 for removal and a tracking adjustment mechanism for keeping the belt 52 tracking centrally on the pulleys 54, 56. Both tracking and tensioning mechanisms for belt drives are well known and thus are not shown. Accordingly, the drive unit 50 clamps the workpieces 11A, 11B, 11C between the belt 52 and the upper and lower side guides 40, 44.

Rotational movement of the belt 52 by means of the drive motor 60 imparts a rotational motion to the workpieces 11A, 11B, and 11C because of the high coefficient of friction of the surfaces of the belt 52 and the upper and lower side guides 40, 44. This rotational motion causes the workpieces 11A, 11B, and 11C to also slide along the surface of the work table 12 and progressively present the entire circumference of the upper and lower peripheral edges of the cylindrical workpieces to the abrasive action of the upper and lower abrasive belts 18, 28. This effectively removes any burrs and forms a slight chamfer or a radius on the edges of the workpieces. The carcase 58 includes a flat vertical face 62 that supports the smooth inside face of the belt 52 for its entire width and as much of its length as possible so that when the belt 52 engages the workpieces, it will impart a positive, smooth, and even rotational and longitudinal motion to the workpieces.

In keeping with an important aspect of the present invention, means are provided so that cylindrical workpieces of varying height and diameter can be accommodated by the deburring machine 10. To accommodate cylindrical workpieces of varying height, the upper linisher 14 is moveable vertically as a unit with the overhead guide 38 and upper side guide 40, thus permitting varying the distance between the overhead guide 38 and the surface of the work table 12. The mechanism for accomplishing this can be any of the well known forms for providing parallel motion. In the illustrated embodiment, the height adjustment mechanism is shown in FIG. 3, in which the upper linisher 14, overhead guide 38, and upper side guide 40 are mounted in fixed relationship to one another to a support frame member 64, so as to be raised or lowered as a unit by a cylinder height adjuster, generally designated 66, that acts on the support frame member 64.

The cylinder height adjuster 66 comprises four threaded rods 68 (only two shown), each having a sprocket 70 secured thereto by a flanged nut 72 and being supported in an overhead support frame member 74 by means of a flanged bushing 76. A chain 78 is trained around each of the four sprockets 70 so that the four threaded rods 68 are rotated in unison by means of rotating a hand wheel or crank 80 mounted to the frame 74 that engages the chain 78 by means of an associated sprocket 82. Alternatively, a motor (not shown) may be substituted for the hand wheel 80. Thus, the relative positions of the overhead guide 38, upper linisher 14, and upper side guide 42 are maintained, while means for the adjustment of the distance between the overhead guide 38 and the work table 12 is provided.

The means for providing diameter adjustment by varying the distance between the drive belt 52 and the upper and lower side guides 40, 42 may also be any of a number of well-known mechanisms for providing parallel motion. With reference to FIG. 2, a diameter adjustment mechanism, generally indicated by 84, is shown. The diameter adjustment mechanism 84 comprises a slideable beam 86 that rests on the work table 12 and to which is secured the belt drive unit 50. A matched pair of screw and sprocket units 88 are each secured to the work table 12 by means of an associated U-shaped, journaled mounting base 90, and are also fixed to the slideable beam 86 at suitable attachment points. Each screw and sprocket unit 88 includes a non-rotating threaded rod 92 fixed to the slidable beam 86 and a rotatable sprocket 94 having an internal screw thread that matches the screw thread of its associated rod 92. Each sprocket 94 is captured between the legs of its associated U-shaped mounting base 90, so as to maintain the sprocket 94 in a fixed position, while still allowing the sprocket 94 to be rotatable with respect to its threaded rod 92. The sprockets 94 are connected together by an endless length of roller chain 96 which is trained about the sprockets 94. Rotary motion of the sprockets 94 moves the threaded rod, and thus the drive belt assembly 50, toward or away from the side guides 40, 44, thus permitting the deburring machine 10 to accommodate cylindrical workpieces of differing diameter. To this end, one of the sprockets 94 includes a second set of teeth 98 that receives a second endless roller chain 100, by which it is connected to a sprocket 102 fixed to a rotatable shaft 104. The shaft 104 is, in turn, secured to the work table 12 by a journaled mounting 106. The shaft 104 and sprocket 102 may be rotated by means of hand wheel or crank 108, thereby affecting rotation of the sprockets 94 to adjust the position of the drive belt unit 50. Again, other suitable motive force, such as a motor, may be substituted for the hand wheel or crank 61 in order to facilitate the diameter-adjustment process.

The angle of the surface of the abrasive belts 18, 28 with respect to their work zones 42, 48 is generally such that the belt engages the peripheral edge of the workpiece at a 45 degree angle with respect to the side wall of the workpiece (as generally seen in FIG. 3). However, some more suitable angle may be verified by experiment. Thus, it may be desirable to be able to adjust the position of the abrasive belts 18, 28 of the upper and lower linishers with respect to their work zones 42, 48. To this end, the upper linisher 14 is mounted to the support frame member 64 by means of a hinged bracket 110 (FIG. 3) that allows for adjustment of the angular relation between the abrasive surface of the belt 18 and the upper work zone by means of a screw adjuster 112. Additionally, packing 114, 116 may be inserted between the support frame 64 and the mounting for the upper linisher 14, overhead guide 38 and upper guide 40 to vary their relative positions, both horizontally and vertically. A similar adjustable mounting arrangement is contemplated for the lower linisher 18 and associated side guide 44, but not shown in the drawings.

It is also desirable to provide for the belts 18, 28 of the linishers 14, 16 to be at some longitudinal angle, or somewhat skewed, with respect to their work zones 42, 48. This helps to insure that the maximum possible area of the abrasive surface of the belts contacts the peripheral edges of the workpiece as the workpiece moves through the work zones. With reference to FIG. 3, adjustment of the longitudinal angle of the lower belt with respect to the lower work zone 48 is achieved by varying the amount of packing 118 between the carcase 34 and its associated support bracket 120. Support bracket 120 may additionally be pivotally mounted to the main supporting frame by means of a hinge pin 122, so as to allow the beam bracket to swing out, thus facilitating replacement of the abrasive belt 28. Again, although the structure has been described and illustrated in conjunction with the lower linisher 16, it could also be used in conjunction with the upper linisher 18.

The deburring machine 10 may also include a safety mechanism 124 (seen in FIG. 2) that includes a kill switch mechanism at the infeed end of the work zone for stopping the drive motors 26, 36, and 60 for the upper linisher 14, lower linisher 16 and drive belt unit 50, respectively. The kill switch 124 is activated in response to a jam caused e.g., by feeding too large a workpiece into the machine or by the operator's finger or glove being caught between the drive belt 52 and the workpieces 11A, 11B or 11C. In the illustrated embodiment, the safety mechanism 124 comprises a spring 126 having sufficient compressive strength to hold the drive belt 52 in firm contact with the workpiece, but not so firm as to cause permanent damage to the finger of an operator should it become caught between the drive belt 52 and the workpiece. A stud 128 and nut 130 serve to adjust the extension limits of the spring 128. The safety mechanism 124 is covered by a guard 132 which is angled at 134 to serve as a lead-in for smooth entry of the workpieces to the work zone of the machine.

Based on the foregoing, a deburring machine has been provided that meets all the objects of the present invention. While the invention has been described in terms of a preferred embodiment, there is no intent to limit the invention to the same. For example, numerous motorized and manual forms for providing parallel movement are contemplated for providing adjustment for workpieces of different height and diameter. Numerous tensioning and tracking adjustment mechanisms for the belts used in conjunction with the present invention are also contemplated. In any event, the invention is defined by the scope of the appended claims.

That which is claimed:

1. An apparatus for removing burrs from a cylindrical workpiece, the workpiece having a cylindrical wall, upper and lower peripheral edges defining upper and lower circular surfaces, and a height and diameter within a pre-determined range, the apparatus comprising:

a worktable having a flat surface for supporting at least one cylindrical workpiece in substantially perpendicular relation thereto so that the lower circular surface of the workpiece rests on the flat surface of the worktable, the worktable having an elongated substantially straight edge;

a first side guide adapted to engage the cylindrical wall of the workpiece adjacent to the lower peripheral edge, the first side guide mounted to the worktable and spaced in substantially parallel alignment with the straight edge of the worktable so as to define a first work zone;

a first continuous elongated movable belt having an abrasive surface mounted to the worktable, the first belt having a first drive motor associated therewith and being disposed in the first work zone so that the abrasive surface of the first belt engages the lower peripheral edge of the workpiece in the first work zone when the cylindrical wall of the workpiece abuts the first side guide;

a second side guide spaced vertically from the worktable in substantially parallel alignment with the first side guide adapted to engage the cylindrical wall of the workpiece adjacent the upper peripheral edge;

an overhead guide spaced from the second side guide adapted to engage the upper circular surface of the workpiece, the overhead guide and second side guide defining a second work zone substantially in alignment with the first work zone;

a second continuous elongated movable belt having an abrasive surface, the second belt having a second drive motor associated therewith and being disposed in the second work zone so that the abrasive surface of the second belt engages the upper peripheral edge of the workpiece in the second work zone when the upper circular surface of the workpiece abuts the overhead guide, the second side guide, overhead guide and second belt forming a unit mounted to the worktable that can be raised or lowered with respect to the worktable to accommodate workpieces having heights within the pre-determined range; and an elongated drive belt having a third drive motor associated therewith and being mounted to the worktable in opposed, substantially parallel relationship to the first and second side guides adapted to engage the cylindrical wall of the workpiece, hold the workpiece in engagement with the first and second side guides, and move the workpiece both rotationally and longitudinally along the surface of the worktable so that the lower and upper peripheral edges of the workpiece are rotated into the first and second work zones to engage the abrasive surfaces of the first and second belts, the relative distance between the drive belt and the first and second side guides being adjustable to accommodate workpieces having diameters within the pre-determined range.

2. The apparatus of claim 1 wherein the first and second continuous elongated belts are mounted so that the abrasive surfaces of the belts engage the peripheral edges of the workpiece at an angle with respect to the cylindrical surface of the workpiece.

3. The apparatus of claim 2 wherein the angle is approximately 45°.

4. The apparatus of claim 1 further comprising a support frame to which the second side guide, overhead guide and second belt are mounted, the support frame being attached to the worktable and is moveable as a unit with respect thereto.

5. The apparatus of claim 1 wherein the first and second continuous belts each defines a longitudinal axis, and the longitudinal axis of each of the first and second belts is disposed at an angle with respect to the work zone so as to maximize the abrasive surface of the belts that engages the peripheral edges of the workpiece as the workpiece moves along the worktable.

* * * * *